US006082645A

United States Patent [19]

Himmighofen et al.

[11] Patent Number: 6,082,645

[45] Date of Patent: Jul. 4, 2000

[54] DEVICE FOR COMMINUTING FOOD PRODUCTS, ESPECIALLY VEGETABLE SLICER

[75] Inventors: Dieter Himmighofen, Roth; Rolf Günter Schülein, Singhofen, both of Germany

[73] Assignee: Leifheit AG, Nassau/Lahn, Germany

[21] Appl. No.: 09/327,669

[22] Filed: Jun. 8, 1999

[30] Foreign Application Priority Data

Jun. 18, 1998 [DE] Germany ..... 198 27 077

[51] Int. Cl.[7] ..... B02C 19/00; B02C 19/20

[52] U.S. Cl. ..... 241/168; 241/169; 241/273.1; 241/285.2

[58] Field of Search ..... 241/168, 169, 241/101.2, 95, 273.1, 285.2, 285.3; 30/283, 293

[56] References Cited

U.S. PATENT DOCUMENTS 875,473 12/1907 Walston ..... 30/283 X
4,120,089 10/1978 Borner ..... 30/278
4,247,054 1/1981 Schulein et al. .
4,570,519 2/1986 Motosko, II ..... 30/283 X
4,624,166 11/1986 Kreth et al. ..... 30/283 X
4,733,589 3/1988 Wolff ..... 30/283 X

FOREIGN PATENT DOCUMENTS 28 16 929 10/1979 Germany .

*Primary Examiner*—John M. Husar
*Attorney, Agent, or Firm*—Frishauf, Holtz, Goodman, Langer & Chick, P.C.

[57] ABSTRACT

To increase the versatility of a household food grater, in which grating inserts can be inserted into a plate-like body formed with an opening, a slicing insert is provided, fitting into the opening. The slicing insert has a frame and a guide path (10) hinged to the frame, and moveable with respect thereto. The frame also carries a knife blade (14). A lever (15) projecting laterally from the frame, adjusts the position of a cutting gap between the knife (14) and the guide path (10) to control the thickness of slices being made, the lever engaging a camming surface of the guide path from beneath the surface on which food is being fed to the knife blade. Adjustment is by interengaging teeth and saw tooth-like depressions, for step-wise adjustment.

12 Claims, 3 Drawing Sheets

DEVICE FOR COMMINUTING FOOD PRODUCTS, ESPECIALLY VEGETABLE SLICER

FIELD OF THE INVENTION

The present invention relates to a device for comminuting food products and more particularly a device to slice cucumbers, tomatoes, or the like, that is, in general, food products which should be processed by being cut into slices.

BACKGROUND

Food product comminuting devices, particularly graters and the like are well known; one such device is described in the referenced DE German patent 28 16 929, assigned to the assignee of the present application. The device there described has a generally plate-like body which defines a food product supply path or guideway leading to an opening carrying grater elements. A plurality of such grater elements are provided, secured in frames which can be laterally introduced into the body element, as desired. It is thus possible to provide a plurality of differently sized grater elements to accommodate different comminuting tasks. For example, it is possible not only to comminute vegetables in general, but also to grate other food products such as nuts, chocolate and cheese to mention only a few examples.

THE INVENTION

It is an object to increase the utility of the device generally described in the aforementioned German patent 28 16 929 by selectively permitting slicing, as well as grating, and thereby enhance the versatility of comminuting features being provided in a single device.

Briefly, one of the inserts, laterally insertable into the body of the comminuting device comprises a knife blade which extends transversely of the body—preferably at an angle with respect thereto—and which further includes a moveable guide path which leads toward the knife blade. The moveable guide path is adjustable with respect to the knife blade to permit selection of the depth of cut, typically slices, of the food product being fed from the guide path to the knife blade.

Preferably, the guide path terminates in advance of the knife blade, leaving a gap. The level of the guide path is adjustable with respect to the knife blade, preferably in steps, for selection of the depth of cut, or the thickness of the slices.

The device, thus, permits solution to the problem to cut slices of any desired thickness, which, previously, could be solved only by having distinct inserts with distinct cutting gaps. By integrating an adjustment mechanism to control the level of the gap between the knife blade and the guide path, a single insert is all that is necessary while permitting cutting of slices of any desired thickness.

In accordance with a feature of the invention, the insert is in the form of a frame. The guide path on the insert is connected to the insert frame by a hinge, preferably, if of plastic, by a living hinge. Adjustment of the cutting gap is easily obtained by an adjustment lever, engaging against the guide path, for example over a camming surface, from beneath the surface on which the food is being fed, hereinafter the bottom side, or underside of the device, or of the frame. This arrangement is simple and is easily cleaned. Complicated adjustment mechanisms are not needed.

The guide path, at the underside surface is preferably formed with saw tooth-like indentations or corrugations to permit placement of the adjustment lever in a selected one of precisely fixed engagement positions. This is particularly desirable to prevent undesired, uncontrolled shifting of the adjustment lever with respect to the guide path, and hence uncontrolled cutting of slices of different thicknesses when pressure is applied on the. food product being fed toward the cutting knife.

DRAWINGS

DETAILED DESCRIPTION

Figure 1:
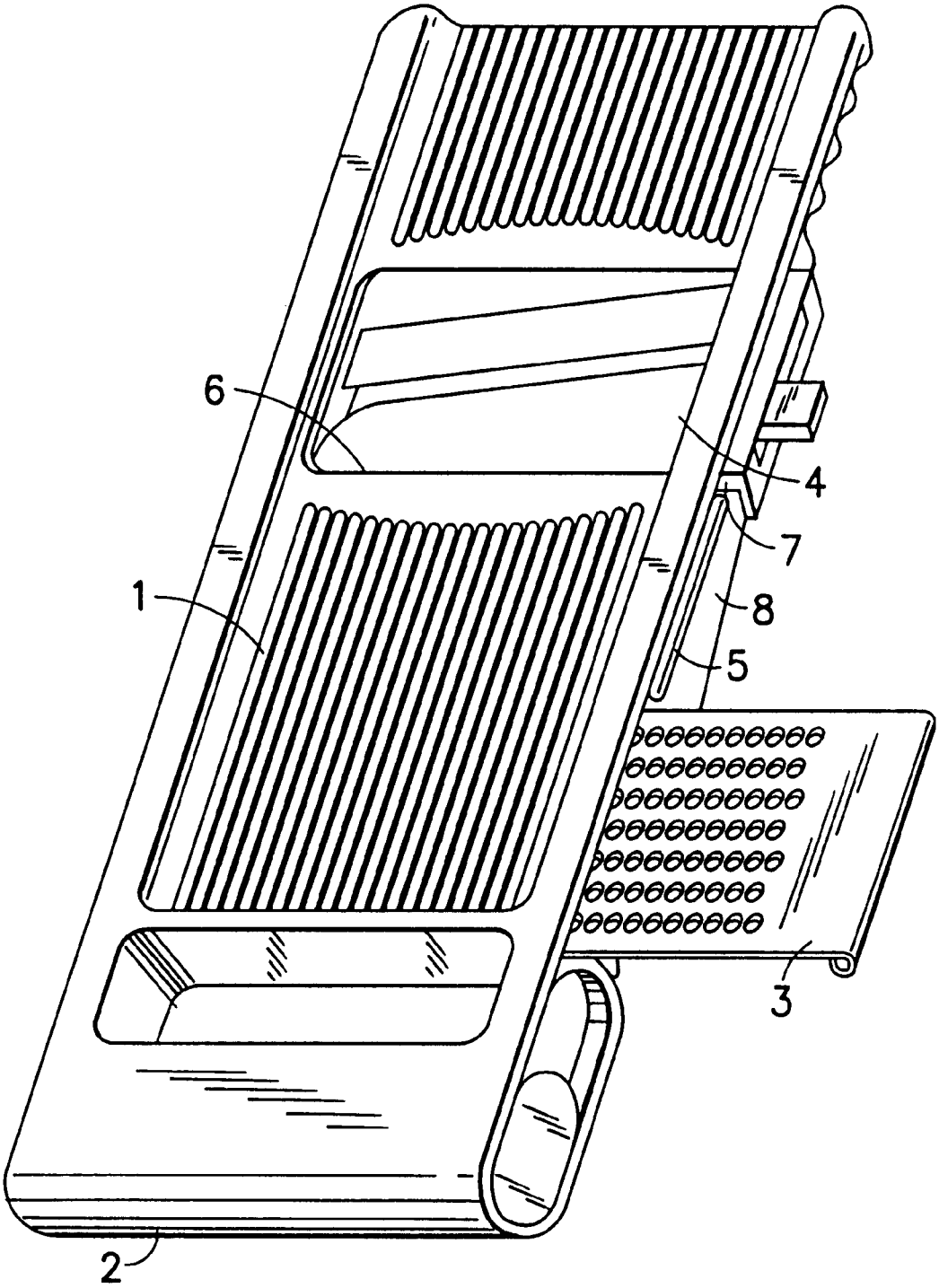
FIG. 1 is a perspective view of a device for comminuting of food products, and illustrating a preferred example.
Figure 2:
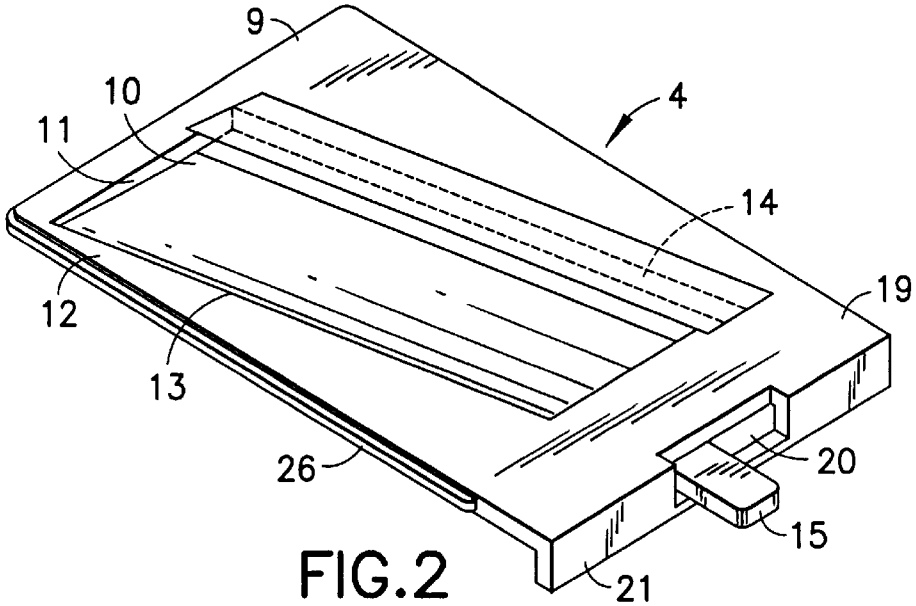
FIG. 2 is a perspective view of a slicing insert.

Referring first to FIG. 1:

The device for comminuting food products, in general, is formed by elongated plate-like base body 1, having a handle 2. It further includes a plurality of comminuting inserts, for example, a grater insert 3. In general, this portion of the device is similar to the one illustrated in the aforementioned German patent 28 16 929. More than one such grating insert 3 may be provided. The grating inserts 3 are located in a suitable reception opening 5 in the base body 1.

In accordance with the feature of the invention, a slicing insert 4 is provided, which, when in use, is located in alignment with an opening 6 of the base plate 1. It can be inserted into the base plate 1 through a lateral slit 7 in side 8 surrounding 30 the opening 6 of the base body 1. The comminuting inserts 3, of which only one is shown, are selectively interchangeable with the slicing insert 4, as desired by the user.

Figure 3:
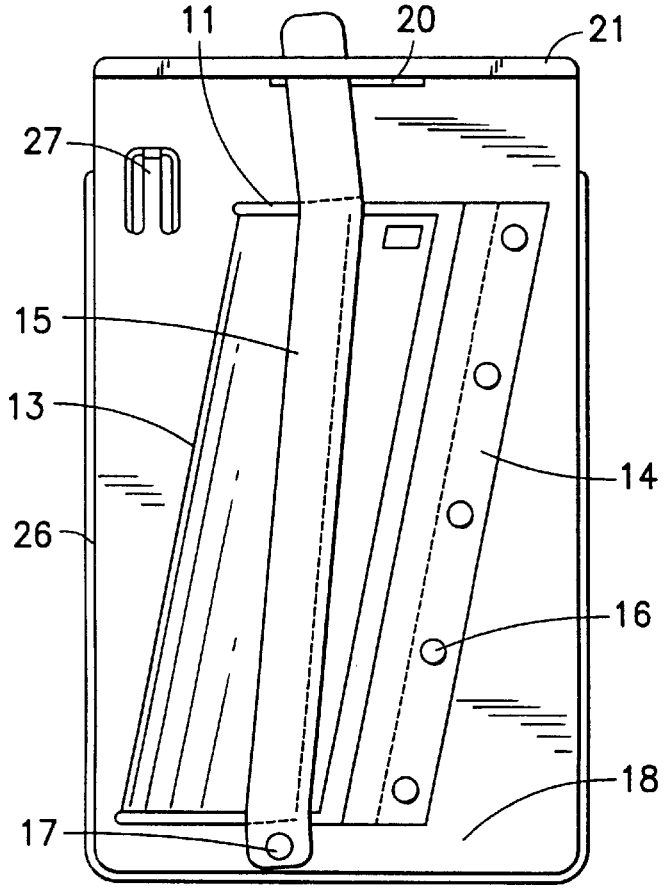
FIG. 3 is a view from below of the slicing insert.
Figure 4:
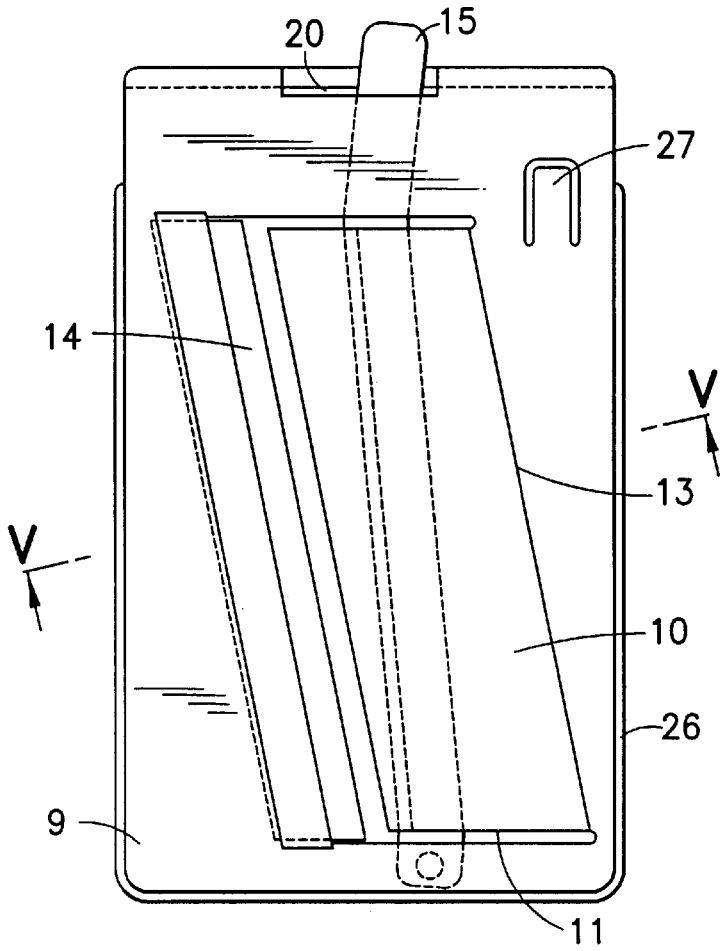
FIG. 4 is a view from above of the slicing insert.

FIGS. 2 to 5 illustrate the slicing insert 4 in greater detail. As shown, it is formed of a slicing insert frame 9, and a guide path 10 which is separated from the frame 9 at three sides by slits 11. At the fourth side 12, the frame 9 and the guide path 10 are coupled by a hinge 13. The entire unit so far described can be made of plastic and the hinge 13 is preferably a living hinge. A knife blade 14 is secured to the frame 9. An adjustment lever 15 is provided to adjust the height of the gap between the guide path 10 and the edge of the knife blade 14. The hinge 13 and the knife 14 are inclined between about 10 to 15 degrees with respect to a transverse axis of the insert 4, in order to permit the user to slice with an easy drawing motion, which facilitates cutting. The knife blade is secured in the frame 9 by plastic rivets 16, as best seen in FIG. 3. The adjustment lever 15 is pivotably secured to a pin 17 at the side 18 of frame 7, that is the side removed from feeding of vegetables to the knife blade. At the lateral side, the lever 17 extends through an elongated opening 20 of a gripping strip 21 (FIG. 2), unitary with the frame 9. The lever 15, thus, can pivot about pin 17. The elongated opening 20 forms a support surface for the lever 15 and, at the same time, defines the extent of the shifting path of the lever 15.

Figure 5:
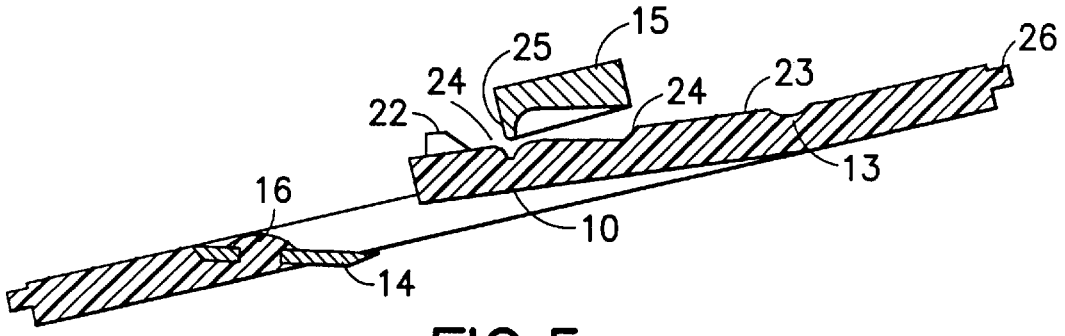
FIG. 5 is a section along line V—V of FIG. 4.

The lever 15, in cross section, is approximately L-shaped see FIG. 5. It is operatively coupled to an inclined surface 22 at the bottom side 23 of the guide path element 10. The guide path element 10 is formed with two transversely extending grooves 24 which form engagement notches to permit an offset nose 25 of the lever 15 to engage therein.

The insert element 4 is guided in the base plate 1 at three sides in grooves which can engage the projecting tips 26

(FIG. 5). A resilient tongue 27 in the frame 9 reliably retains the insert 4 in the plate-like base body 1.

Various changes and modifications may be made within the scope of the inventive concept.

We claim:

1. A comminuting device comprising:

a plate-like body (1);

at least one insert reception opening (5, 7) formed in the body, and laterally accessible for placement of an insert (3, 4) therein, wherein one said insert comprises a knife blade (14), extending transversely to the body (1), and a moveable guide path (10) leading toward the knife blade and adjustably positionable with respect to the knife blade (14) to permit selection of a depth of cut of a food product which is fed from the guide path (10) to the knife blade (14), and wherein an adjustment lever (15) is provided transversely to and beneath the guide path (10) for adjustable positioning the guide path (10) with respect to the knife blade (14).

2. The device of claim 1 wherein the guide path (10) terminates in advance of the knife blade (14) leading to a gap (11); and wherein a level of the guide path (10) with respect to the knife blade (14) is adjustable, in steps, to control a dimension of the gap (11), and thus permit selection of the depth of cut of the food product which is fed from the guide path (10) to the knife blade (14).

3. The device of claim 1 wherein said one insert further comprises a frame (9), and a hinge (13) connecting the guide path (10) to the frame (9) at a side of the guide path (10) opposite to said knife (14), and wherein said lever (15) is pivotably secured in the frame (9) for controlling a width of said gap (11).

4. The device of claim 3 wherein said frame (9) comprises an angled-off handle strip (21) which is pierced by an elongated opening (20) through which said lever (15) extends, and wherein an extent of said opening (20) defines a movement of said lever (15) and forms an engagement abutment therefor.

5. The device of claim 3 wherein a bottom side (23) of said guide path (10) is formed with an inclined portion (22) operatively coupled to said lever (15).

6. The device of claim 5 wherein said lever (15) and the bottom side (23) of said guide path (10) are interengageable.

7. The device of claim 6 wherein said at least one groove is formed in the bottom side (23) of the guide path (10), and said lever (15) is formed with a projecting nose which is engageable in said at least one groove.

8. The device of claim 7 wherein at least one of said inclined portion (22) and the bottom side (23) of the guide path (10) has a plurality of saw-tooth shaped depressions to define a plurality of positions of the guide path (10) with respect to the knife blade (14).

9. A kitchen slicer comprising:

a plate-like elongated body (1) formed with a food processing opening (6) extending therethrough;

at least one slit (7) laterally extending into said body (1);

an insert (4) insertable through said at least one said slit (7), said at least one slit (7) being in alignment with said opening (6) in the body (1), and said insert (4) comprising a frame (9);

a guide path portion (13) hinged at one side to said frame (9), and a knife blade (14) positioned opposite said hinged side and retained in said frame (9); and an adjustment lever (15) located beneath said guide path (10) and shiftable with respect to a longitudinal extent of said body (1), said lever (15) being engaged with a bottom side (23) of said guide path (10) to control a spacing between the knife blade (14) and said hinged side of the guide path (10) opposite the knife blade (14) so as to control a slicing thickness.

10. The device of claim 9 wherein said lever (15) and the bottom side (23) of the guide path (10) are interengageable for positively positioning the lever (15) and the guide path (10).

11. The device of claim 9 wherein said frame (9) includes a gripping strip (21) formed at one lateral side thereof, and said lever (15) extends through an opening (20) in the gripping strip (21) for providing access to the lever (15) when the frame (9) is inserted in said body (1).

12. The device of claim 9 further including a locking tongue (27) protruding from a flat surface of said frame (9) for engagement against the body (1) and for securing said frame (9) in said body (1) when the frame (9) is inserted in the body (1).

* * * * *